US007377883B1

(12) United States Patent
Blanton

(10) Patent No.: US 7,377,883 B1
(45) Date of Patent: May 27, 2008

(54) MARTIAL ARTS KICKING APPARATUS

(76) Inventor: Stephen F. Blanton, 7206 Lake Ola Dr., P.O. Box 22, Tangerine, FL (US) 32777

( * ) Notice: Subject to any disclaimer, the term of this patent is extended or adjusted under 35 U.S.C. 154(b) by 0 days.

(21) Appl. No.: 11/699,233

(22) Filed: Jan. 30, 2007

(51) Int. Cl.
*A63B 69/22* (2006.01)
*A63B 67/00* (2006.01)

(52) U.S. Cl. ..... 482/90; 482/83; 273/456

(58) Field of Classification Search ..... 482/83–90; D21/787, 798; 273/440.1, 456; 446/92, 446/137

See application file for complete search history.

(56) References Cited

U.S. PATENT DOCUMENTS 3,320,686 A * 5/1967 Blackburn ..... 434/302
3,883,135 A * 5/1975 Milliken ..... 472/69
3,926,316 A * 12/1975 Luttrell ..... 212/259
3,973,772 A * 8/1976 Milliken ..... 482/83
4,201,379 A 5/1980 Williams
4,253,706 A * 3/1981 Hay ..... 299/100
4,309,029 A 1/1982 Tomko
4,757,989 A * 7/1988 Bauer, Jr. ..... 482/83
4,817,941 A 4/1989 McCorry
5,152,733 A * 10/1992 Farenholtz et al. ..... 482/135
5,277,679 A 1/1994 Wells
5,458,551 A * 10/1995 Shenton ..... 482/83
5,476,433 A 12/1995 Bruner
5,527,185 A 6/1996 Davis
5,665,035 A 9/1997 Tumminia
5,823,537 A 10/1998 Blanton
6,217,490 B1 * 4/2001 Wurtak ..... 482/83
6,273,834 B1 * 8/2001 Winter ..... 473/484

* cited by examiner

*Primary Examiner*—Loan H. Thanh
*Assistant Examiner*—Allana Lewin
(74) *Attorney, Agent, or Firm*—William M. Hobby, III

(57) ABSTRACT

A martial arts kicking apparatus has a base with a post hinged to the base so that the post can be raised or lowered. The post support arm is hinged to the base and attached to the post for supporting the post. The post may be a telescoping post and has an elongated telescoping arm attached to one end thereof. A kick stick support arm is attached to the elongated arm and a kick stick is magnetically attached to the kick stick support arm for separation from the kick stick support arm when receiving a kick of predetermined force so that a martial arts kicking apparatus can be used for practice or in the martial arts game. A means to vary the magnetic force holding the kick stick to the kick stick support arm may be a movable permanent magnetic movably mounted to the kick stick support to vary the distance between the magnet and the kick stick or can be an electromagnet having a variable magnetic field. The kick stick has an arm or a magnet placed therein positioned for being attractive to the kick stick support arm magnet. The kick stick support arm is rotatably and positionable in a variety of positions for practicing martial arts kicking.

13 Claims, 3 Drawing Sheets

MARTIAL ARTS KICKING APPARATUS

BACKGROUND OF THE INVENTION

This invention relates to a martial art kicking apparatus for use by martial artists or anyone wishing to develop a kicking technique and power and to a kick stick removably attached to the apparatus.

Persons in the martial arts, such as Karate, Kung Fu, Tae Kwon Do, and the like, have been for many years trained by hitting or kicking a striking pad, bag, boards or other members. Martial art students try to develop split second reflexes of a physical and mental nature and constantly train themselves to be able to perceive, analyze, and react to a given situation rapidly. Various techniques of developing such reflexes have been widely used. A martial art student can practice with a partner or teacher or can drill to instructions from a teacher. The martial arts have also attracted spectator interest in the United States and other countries in response to a growing awareness of oriental culture. However, training in martial arts has commonly been practiced between two individuals or between a student and an individual or teacher in a training facility.

There have also been a wide variety of training devices, such as breaking board devices and other devices for use in practicing martial arts. One of the most common types of training devices has been striking surfaces of different types. Striking surfaces have included posts buried in the ground, makawari boards, which are boards mounted in a holding fixture and having striking areas which are covered with foam, straw, or the like. Punching bags have commonly been used and are generally hung from above or placed on the floor or suspended between the floor and ceiling. Hand-held striking surfaces are used which allow the target to be moved from place-to-place by a training partner. It has also been suggested to provide striking surfaces which include sensors for measuring the force of the strike. Breaking boards include one or more boards held by a training partner which are broke by a sharp blow with the hand or foot.

My prior U.S. Pat. No. 5,823,537 is for a martial arts game and to a method of playing a game utilizing martial arts. This game is a full contact sport which brings the martial arts into more of a spectator sport. This martial arts game includes a predetermined playing field marked off in a predetermined manner and having a goal post at each end thereof. The goal posts have a removably attached kick scoring member attached to a predetermined position. The present invention for a martial arts kicking apparatus is ideally suited for using as a goal post in this martial arts game.

Other prior U.S. patents to martial arts training devices can be seen in the Wells U.S. Pat. No. 5,277,679 for a martial arts practice apparatus for improving the skills in the art of kicking or punching a target and includes a target which resists rotation on the shaft but which returns a target to a neutral position. The McCorry U.S. Pat. No. 4,817,941 has an adjustable target holder for martial art training having a horizontally adjustable target holder mounted to a base. In the U.S. Pat. No. 4,309,029 to Tomko, a martial arts striking machine is provided while the Williams U.S. Pat. No. 4,201,379 has a martial arts practice bag. The Davis U.S. Pat. No. 5,527,185 is an athletic training device. The Tumminia U.S. Pat. No. 5,665,035 is a martial arts training apparatus as is the Bruner U.S. Pat. No. 5,476,433.

SUMMARY OF THE INVENTION

A martial arts kicking apparatus has a base with a telescoping post hinged to the base so that the post can be raised or lowered. A post support arm is hinged to the base and is attached to the post for supporting the post in a raised position. The telescoping post has an elongated telescoping arm attached to one end thereof. A kick stick support arm is attached to the elongated arm and a kick stick is magnetically attached to the kick stick support arm for separation from the kick stick support arm when receiving a kick of predetermined force, allowing the martial arts kicking apparatus to be used for kicking practice or in the a martial arts game. A means to vary the magnetic force holding the kick stick to the kick stick support arm may be a movable permanent magnetic movably mounted to the kick stick support to vary the distance between the magnet and the end of the kick stick. An electromagnet having a variable magnetic field can also be utilized. The kick stick has a magnetic material thereon, such as a permanent magnet or a ferric material placed therein positioned for being attractive to the kick stick support arm magnet. The kick stick support arm is rotatably and positionable in a variety of positions for practicing martial arts kicking.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENTS

Figure 1:
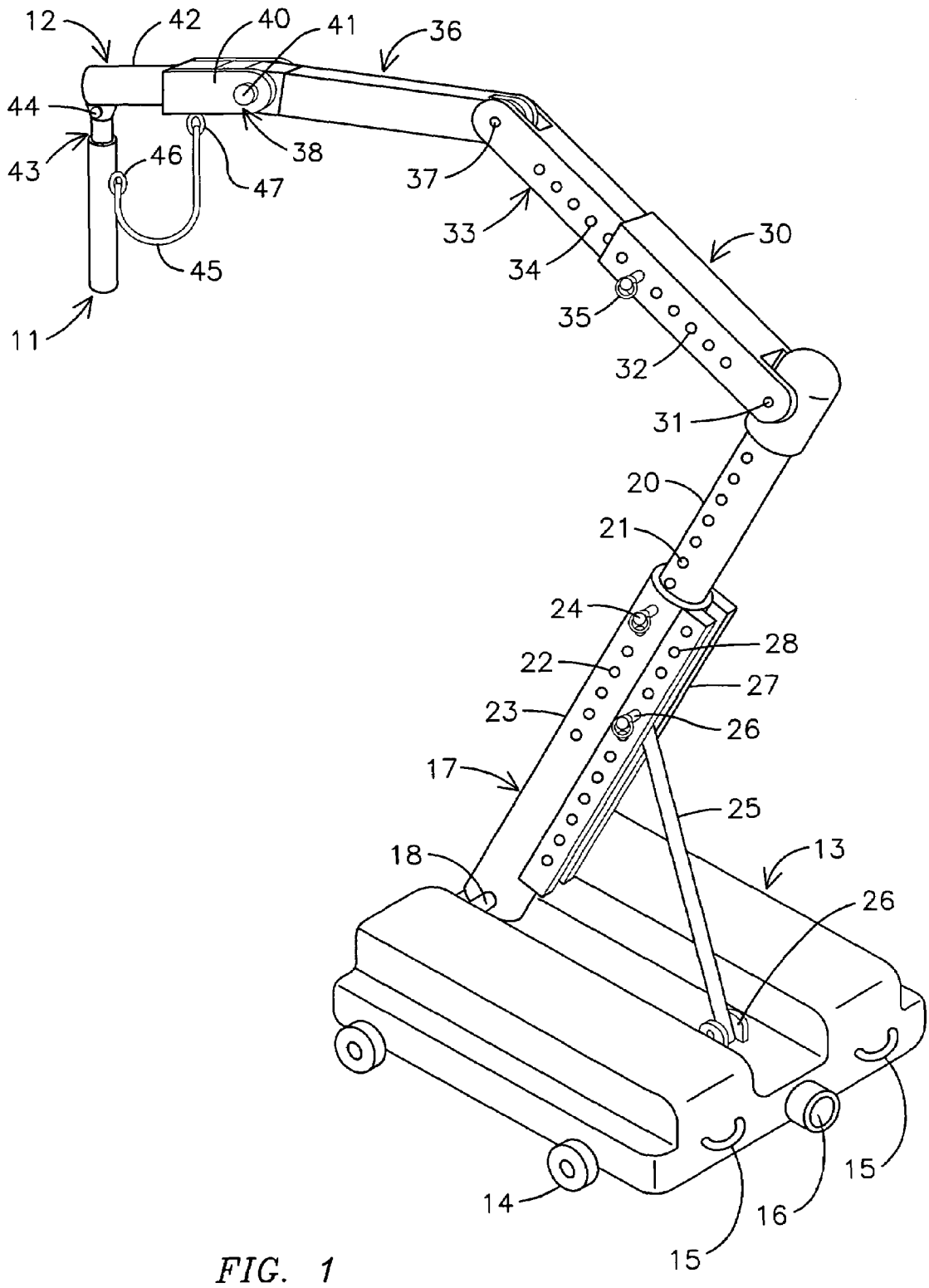
FIG. 1 is a perspective view of a martial arts kicking apparatus in accordance with the present invention.
Figure 2:
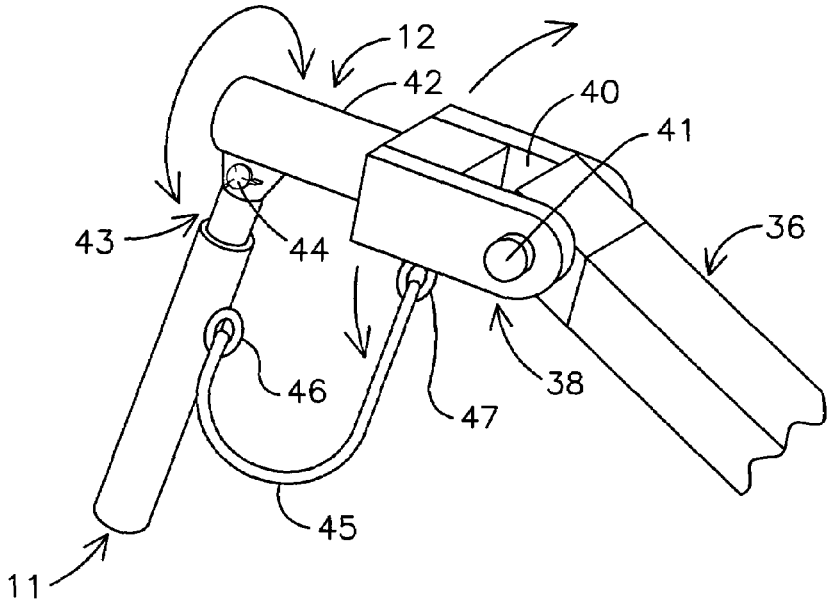
FIG. 2 is a perspective view of a kick stick supporting head of a martial arts kicking apparatus of FIG. 1.
Figure 3:
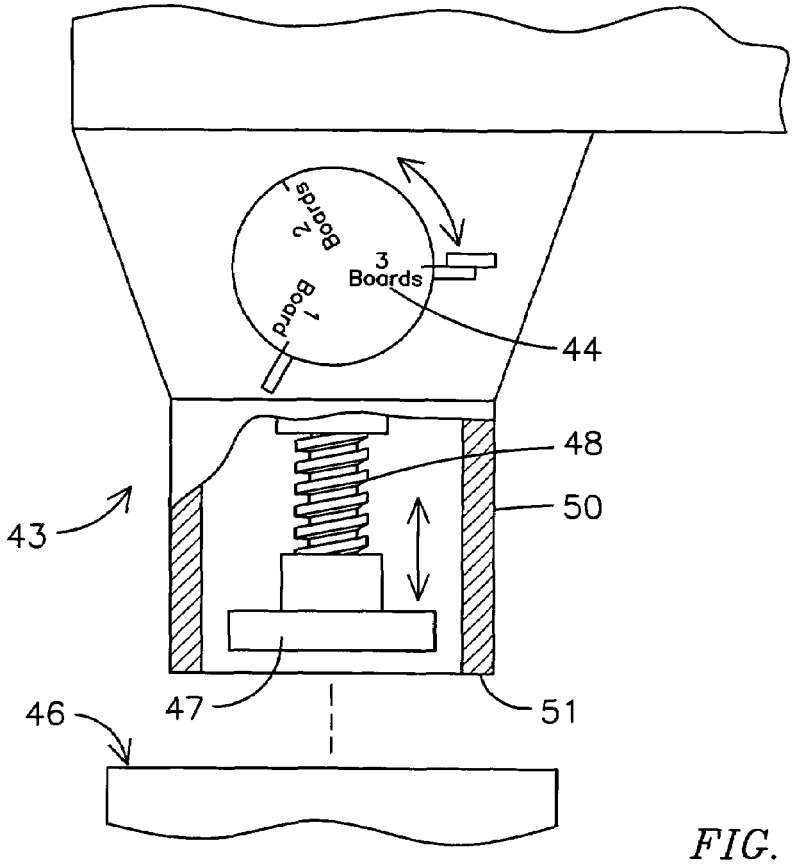
FIG. 3 is a cut away perspective view of the kick stick supporting head.

Referring to the drawings of FIGS. 1 through 4, a martial arts kicking apparatus 10 is illustrated supporting a kick stick 11 on the kick stick supporting head 12. The martial arts kicking apparatus 10 has a base 13 having a plurality of wheels 14 as well as eyes 15 for attaching a cable or the like for moving the apparatus 10 on the wheels 14. An opening 16 in the base 13 allows the base to be filled with additional weight, such as sand or water as desired. The base has a telescoping post 17 hinged with a hinge pin 18 having a telescoping post member 20 extending therefrom. The telescoping post member 20 has a plurality of openings 21 therein which can be aligned with a plurality of openings 22 in the post base 23 and locked together with a pin 24. The post 17 has a post support arm 25 which is hinged with the hinge 26 to the base 13 and locks to the post 17 with a locking pin 26 engaging a locking rack 27 attached to the post 17. The locking rack 27 has a plurality of openings 28 for sliding a locking pin 26 thereinto so that the post 17 can be locked in different positions at different angles depending on the position of the post support arm locking in one of the plurality of openings 28.

A telescoping elongated arm 30 is attached to the post 17 telescoping portion 20 with a locking pin 31. The telescoping arm 30 has a plurality of openings 32 therein while the telescoping arm portion 33 has a plurality of openings 34 therein so that a locking pin 35 can lock the telescoping arm 30 in different lengths of extension of the telescoping arm portion 33. A kick stick support arm 36 is hinged with a locking hinge 37 to the telescoping arm portion 33 and has a universal kick stick supporting head 38. The supporting head 38 is a universal joint formed with a yoke 40 hinged on a locking pin 41 to allow rotation in one direction while the rotating arm 42 allows rotation in a perpendicular direction to the rotation of the head portion 40.

A kick stick attaching portion 43 allows the kick stick 11 to be attached thereto and also allows for the adjustment of the strength of the attachment with the rotating handle 44. A lanyard or cable 45 connects to the kick stick 11 eye 46 at one end and to the kick stick supporting head eye 47 at the other end so that when the kick stick 11 is kicked from the kick stick attachment 43, it is captured and held by the lanyard 45. One end of the kick stick 11 has a magnetic material 46 attached thereto which can be a permanent magnet or a magnetic material, such as soft iron. The kick stick attachment portion 43 includes a permanent magnet 47 which is mounted to an adjustable screw 48 and is mounted within a hollow sleeve 50. Rotation of the handle 44 rotates the screw 48 to raise or lower the magnet 47 to push it further into or out of the sleeve 50 away from the end 51 of the sleeve. The magnetic material 46 of the kick stick which is supported against the edge 51 is positioned closer or further away from the magnet 47 depending on the position of the screw 48. Thus, the strength of the connection of the kick stick 11 can be varied if the kick stick attachment 43 magnet 47 is facing a magnet 46 on the kick stick, then they would be positioned with the magnet poles of opposite polarities facing each other so as to form an attraction to each other. It should also be clear that the magnet 47 can attract a magnetic material, such as a piece of iron.

Figure 4:
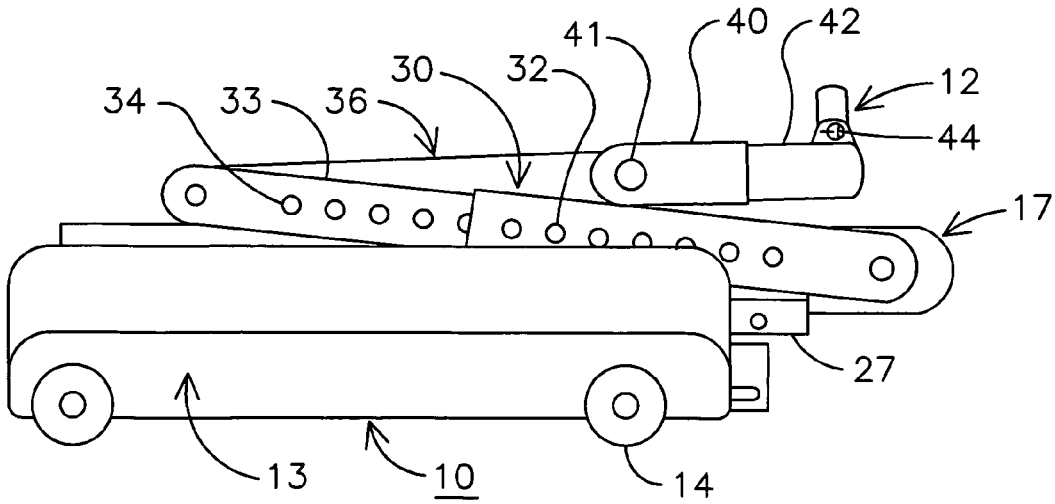
FIG. 4 is a side sectional view of the martial arts kicking apparatus of FIG. 1 in a folded positioned.

FIG. 4 illustrates the martial arts kicking apparatus 10 in a folded position.

Figure 5:
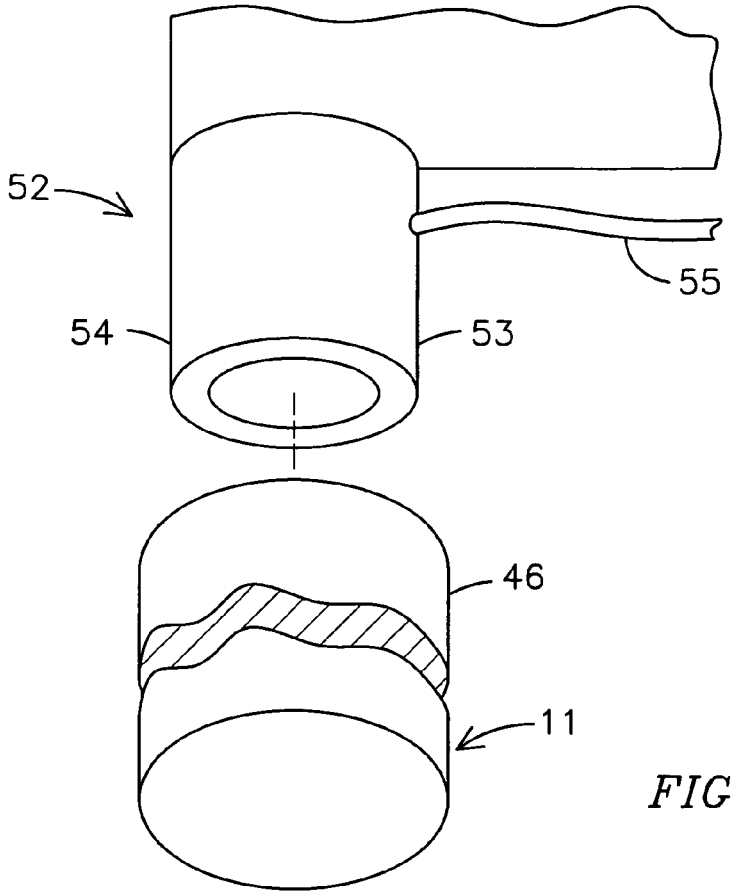
FIG. 5 is a perspective view of an alternate embodiment of the kick stick supporting magnet.

Turning to FIG. 5, an alternate embodiment of a magnetic kick stick attaching head 52 is illustrated having an electromagnet 53 having a wound coil therein located in a tube 54 which may also include a soft iron core for engaging the magnet material 46 of the kick stick 11. Varying the voltage in the electric line 55 can vary the magnetic attraction of the electromagnet 53 to vary the hold between the electromagnet 53 and the magnetic material 46 of the kick stick 11.

It should be clear at this time that a martial arts kicking apparatus has been provided which can advantageously be positioned in any position desired with a universal kick stick supporting head allowing any adjustment along with a telescoping adjustable post and arm supporting the arm to allow positioning the kick stand at any height and position desired. Advantageously, the attachment of the kick stick to the kick stick supporting head can be adjusted in strength to require differing amounts of force for kicking the kick stick from the supporting head. The difficulty of kicking the kick stick loose varies due to the varying strength of the magnetic force. The aim of the present kick stick supporting apparatus is to develop better kicks for use in the sport of martial arts or in accordance with my prior martial arts game. However, the present invention is not to be construed as limited to the forms shown which are to be considered illustrative rather than restrictive.

I claim:

1. A martial arts kicking apparatus comprising:

a base;

a post hinged to said base;

a post support arm hinged to said base and attached to said post;

an elongated arm attached to said post;

a kick stick support arm attached to said elongated arm; and a kick stick magnetically attached to said kick stick support arm for separation from said kick stick support arm when receiving a kick of predetermined force; whereby a martial arts kicking apparatus can be used for practice or in a martial arts game.

2. The martial arts kicking apparatus in accordance with claim 1 having means to vary the magnetic force holding said kick stick to said kick stick support arm.

3. The martial arts kicking apparatus in accordance with claim 2 in which said means to vary the magnetic force includes a movable permanent magnet movably mounted to said kick stick support arm to vary the distance between the magnet and the kick stick.

4. The martial arts kicking apparatus in accordance with claim 2 in which said means to vary the magnetic force includes an electromagnet having a variable magnetic field.

5. The martial arts kicking apparatus in accordance with claim 2 in which said post is a telescoping post for varying the height of said post.

6. The martial arts kicking apparatus in accordance with claim 5 in which said telescoping post has a telescoping portion having a plurality of apertures therein extending from a post base portion having a plurality of apertures therein and a locking pin for locking extending through aligned apertures for locking the telescoping post is a plurality of positions.

7. The martial arts kicking apparatus in accordance with claim 6 in which said telescoping arm has a telescoping portion having a plurality of apertures therein extending from an arm base portion having a plurality of apertures therein and a locking pin for extending through aligned apertures for locking the telescoping arm is a plurality of positions.

8. The martial arts kicking apparatus in accordance with claim 2 in which said kick stick support arm has kick stick support head thereon having a kick stick holding end having a magnet mounted thereon and said kick stick has magnetic material mounted on at least one end thereof.

9. The martial arts kicking apparatus in accordance with claim 8 in which said kick stick support head magnet is a permanent magnet movably mounted to said kick stick holding end.

10. The martial arts kicking apparatus in accordance with claim 9 in which said kick stick support head magnet is a permanent magnet movably mounted to said kick stick holding end to vary the distance between the said magnet and said kick stick to vary the strength of the magnetic hold of said kick stick to said kick stick support arm.

11. The martial arts kicking apparatus in accordance with claim 8 in which said kick stick support head magnet is an electromagnet.

12. The martial arts kicking apparatus in accordance with claim 8 in which said kick stick support arm kick stick support head forms a universal joint allowing movement of said kick stick support head in any direction.

13. The martial arts kicking apparatus in accordance with claim 8 in which said kick stick has an elongated flexible member is attached to said kick stick and to said kick stick support head to capture said kick stick when kicked loose from said kick stick support head.

* * * * *